US006915647B2

(12) United States Patent
Tsuchikawa et al.

(10) Patent No.: US 6,915,647 B2
(45) Date of Patent: Jul. 12, 2005

(54) ABNORMALITY DETECTING DEVICE OF AUGER-TYPE ICE MAKING MACHINE AND ABNORMALITY DETECTING METHOD THEREOF

(75) Inventors: Koji Tsuchikawa, Toyoake (JP); Masanobu Nagira, Toyoake (JP)

(73) Assignee: Hoshizaki Denki Kabushiki Kaisha, Toyoake (JP)

( * ) Notice: Subject to any disclaimer, the term of this patent is extended or adjusted under 35 U.S.C. 154(b) by 131 days.

(21) Appl. No.: 10/443,449

(22) Filed: May 21, 2003

(65) Prior Publication Data

US 2004/0231354 A1 Nov. 25, 2004

(51) Int. Cl.[7] ..... F25C 1/14
(52) U.S. Cl. ..... 62/129; 62/136; 62/354
(58) Field of Search ..... 62/125, 126, 129, 62/136, 354

(56) References Cited

U.S. PATENT DOCUMENTS

| | | | | |
|---|---|---|---|---|
| 3,650,121 A | * | 3/1972 | Kimpel et al. | 62/136 |
| 4,426,851 A | * | 1/1984 | Neumann | 62/126 |
| 4,472,129 A | | 9/1984 | Siard | 425/381 |
| 5,286,183 A | | 2/1994 | Tonsi et al. | 425/113 |
| 5,346,384 A | | 9/1994 | Hegler et al. | 425/381 |
| 5,690,971 A | | 11/1997 | Buluschek | 425/113 |
| 6,694,752 B2 | * | 2/2004 | Nomura et al. | 62/136 |

FOREIGN PATENT DOCUMENTS

| | | |
|---|---|---|
| CA | 635727 | 1/1962 |
| GB | 166915 | 7/1921 |
| JP | 4-24625 | 4/1992 |
| JP | 2941112 | 6/1999 |

* cited by examiner

*Primary Examiner*—William E. Tapolcai
(74) *Attorney, Agent, or Firm*—Fish & Richardson P.C.

(57) ABSTRACT

An auger-type ice making machine has an abnormality detecting device which detects a freezing of an ice-scraping auger on the basis of a hunting of current flowing through an auger motor 25. Current flowing through the auger motor 25 is taken out by a current-voltage converter 45, and an instantaneous value of the taken-out voltage,waveform every predetermined time is A/D converted by an A/D converter 52 which is provided at a controller board 50. A microcomputer 51 detects a peak value from the A/D converted instantaneous value for determining that abnormal current flows through the auger motor 25, when a hunting of the peak value occurs a predetermined number of times or more that is not less than 2 during a predetermined time, or when the state where the hunting of the peak value occurs a predetermined number of times or more that is not less than 2 during a first predetermined time is detected a predetermined number of times or more that is not less than 2 during a second predetermined time that is longer than the first predetermined time. As for the number of hunting times, a state wherein the peak value once becomes greater than a predetermined value, and then, becomes smaller than the predetermined value is counted as one number of hunting times.

16 Claims, 5 Drawing Sheets

ABNORMALITY DETECTING DEVICE OF AUGER-TYPE ICE MAKING MACHINE AND ABNORMALITY DETECTING METHOD THEREOF

BACKGROUND OF THE INVENTION

1. Field of the Invention

The present invention relates to an abnormality detecting device and an abnormality detecting method of an auger-type ice making machine for detecting an abnormality such as a freezing of an ice-scraping auger caused by an overgrowth of ice in a refrigerating cylinder.

2. Description of the Prior Arts

An auger-type ice making machine has conventionally been well-known wherein overcurrent is prevented from continuously flowing in an auger motor for driving an ice-scraping auger over a long period of time, in case that the ice-scraping auger becomes unrotatable because the auger is frozen due to an overgrowth of ice in a refrigerating cylinder. For example, Japanese Patent No. 2941112 discloses that an overcurrent breaker for cutting a circuit in response to overcurrent is provided on a path for supplying current to an auger motor, wherein the path for supplying current to the auger motor is cut by a protection device when an ice-scraping auger becomes unrotatable so that overcurrent flows in the auger motor.

Further, Japanese Examined Patent Publication No. HEI 4-24625 discloses a protection device that converts current flowing in the auger motor into voltage and controls to stop the driving of the auger motor when the converted voltage exceeds a predetermined voltage. In this latter protection device, the control for stopping the driving of the auger motor by the above-mentioned converted voltage is inhibited during a predetermined period from the start of the auger motor so as not to stop the driving of the auger motor due to great rush current upon the start of the auger motor.

In this type of auger-type ice making machine, in case where the ice-scraping auger becomes unrotatable due to the freezing of the ice-scraping auger, the auger does not completely become unrotatable, but an excessive load is intermittently given with respect to the rotation of the auger at its initial stage, i.e., at the time when the ice-scraping auger starts to freeze. Therefore, current flowing through the auger motor becomes excessive intermittently, i.e., a hunting starts to occur in the current flowing through the auger motor, with this state. However, the overcurrent breaker in the above-mentioned former conventional protection device does not respond to the hunting, since this protection device does not activate the overcurrent breaker with rush current at the start of the auger motor and instantaneous great current flowing through the auger motor, but activates the same only when great current flows through the auger motor over a long period to some extent. As a result, the above-mentioned former conventional protection device has a problem that a delay occurs in detecting an abnormality caused by the freezing of the ice-scraping auger in the auger-type ice making machine.

Further, the above-mentioned latter conventional protection device is required to stop the operation of the auger motor by activating the overcurrent breaker only when great current flows through the auger motor over a long period to some extent, since it prevents the auger motor from stopping with instantaneous great current like the former case. As a result, the above-mentioned latter conventional protection device also has a problem that a delay occurs in detecting an abnormality caused by the freezing of the ice-scraping auger in the auger-type ice making machine. Moreover, the latter protection device is required to count a time from the start of the auger motor for inhibiting the control to stop the operation of the auger motor during a predetermined time from the start of the auger motor.

SUMMARY OF THE INVENTION

The present invention is accomplished in view of the above-mentioned problems, and aims to provide an abnormality detecting device and abnormality detecting method of an auger-type ice making machine for rapidly and accurately detecting an abnormality of the auger-type ice making machine caused by a freezing of an ice-scraping auger.

In order to accomplish the above-mentioned object, the present invention has a feature in its configuration that an abnormality occurred in the auger-type ice making machine is detected on the basis of a hunting in current flowing through the auger motor. Particularly, the abnormality is determined to be generated in the auger-type ice making machine when the hunting occurs in the current flowing through the auger motor a predetermined number of times or more that is not less than 2 during a predetermined time. It is to be noted that a state wherein the current flowing through the auger motor (a DC current value if a DC motor is used and an amplitude value of AC current if an AC motor is used) once becomes greater than a predetermined value, and then, becomes smaller than the predetermined value is counted as one number of hunting times. In this case, the detection of the abnormality by the hunting may be executed when a state wherein the current flowing through the auger motor crosses over a reference value in either one of directions from bottom to top and top to bottom is detected a predetermined number of times or more that is not less than 2 during a predetermined time.

Additionally, the present invention has another feature in its configuration that it is provided with hunting detection means for detecting as an occurrence of a hunting that a hunting occurs a predetermined number of times or more that is not less than 2 in the current flowing through the auger motor during a first predetermined time, and abnormality determining means for determining that an abnormality occurs in the auger-type ice making machine when the hunting detection means detects a predetermined number of times or more that is not less than 2 that the hunting occurs in the current flowing through the auger motor during a second predetermined time that is longer than the first predetermined time. In this case, the configuration having the same function as the hunting detection means in the above mentioned configuration may be composed of crossing detection means for detecting that the current flowing through the auger motor crosses over a reference value in either one of directions from bottom to top and from top to bottom, and hunting detection means for detecting as an occurrence of a hunting that the crossing detection means detects the crossing a predetermined number of times or more that is not less than 2 during a first predetermined time.

According to these features, the occurrence of the abnormality in the auger-type ice making machine is determined when the ice-scraping auger starts to freeze to thereby start to cause a hunting in the current flowing through the auger motor, whereby the abnormality is rapidly and accurately detected to suppress an adverse effect on the auger motor to a minimum. Further, the abnormality is detected when a hunting occurs in the current flowing through the auger motor a predetermined number of times or more that is not less than 2 during a predetermined time, whereby the abnormality in the auger-type ice making machine is not erroneously detected even if great rush current flows through the auger motor at its start or great current instantaneously flows through the auger motor.

DESCRIPTION OF THE PREFERRED EMBODIMENT

Figure 1:
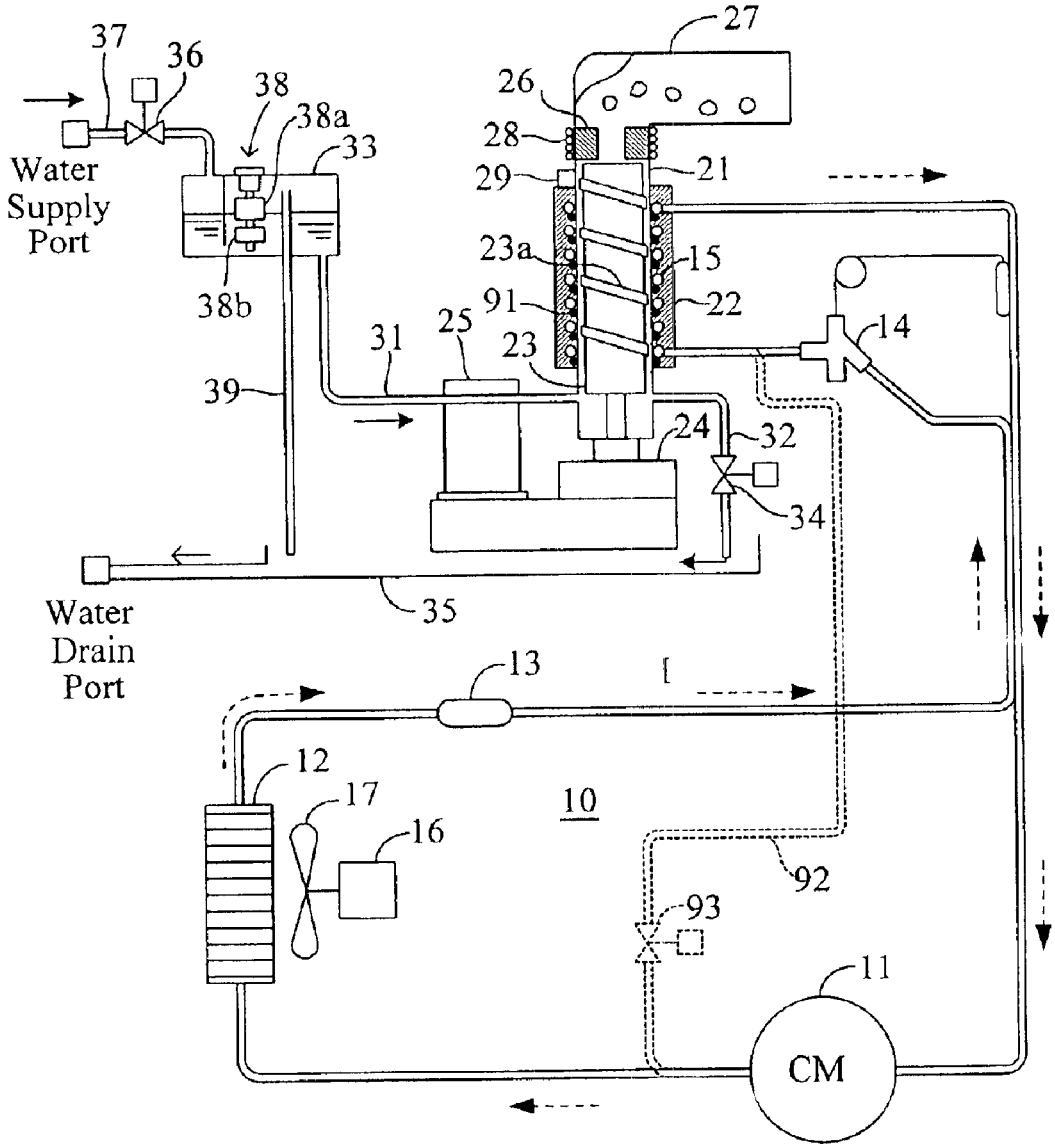
FIG. 1 is an overall schematic view of an auger-type ice making machine according to one embodiment of the present invention.

Explaining hereinbelow one embodiment of the present invention, FIG. 1 schematically shows an overall configuration of an auger-type ice making machine according to the embodiment.

This auger-type ice making machine comprises a well-known refrigerant circuit system 10 for circulating a refrigerant in the direction indicated by broken-line arrows, including a refrigerant compressor 11, a condenser 12, a dryer 13, an expansion valve 14 and an evaporation pipe 15, all of which are interconnected in this order by way of pipes. The condenser 12 is provided with a cooling fan 17 driven by a fan motor 16 for cooling the condenser 12. The evaporation pipe 15 is wound around a refrigerating cylinder 21 in intimate contact with the outer peripheral surface thereof and is covered with a heat insulating material 22.

The refrigerating cylinder 12 has accommodated therein a cylindrically formed ice-scraping auger 23 that is coaxially rotatable. The ice-scraping auger 23 has its lower end connected to a reduction gear 24 to thereby be rotatably driven by a driving torque transmitted from an auger motor 25 composed of an AC motor through the reduction gear 24. The ice-scraping auger 23 has provided on its outer peripheral surface a spiral blade 23*a* for scraping ice formed on the inner surface of the refrigerating cylinder 21. Disposed at the top portion of the refrigerating cylinder 21 is a press head assembly 26 for reducing the area of the inner path.

The press head assembly 26 compresses and dewaters ice crystals scraped off and fed by the spiral blade 23*a* of the ice-scraping auger 23 as well as transforms the ice crystals into flake-like pieces, and then, delivers them to a discharge cylinder 27 connected to an ice storage bin not shown. A thawing heater 28 is wound around the outer periphery of the press head assembly 26 so as to afford facility for scraping the compressed and dewatered ice crystals off the inner surface of the press head assembly 26. Disposed further at the refrigerating cylinder 21 is a thermostat 29 that is in an on-state when the temperature of the refrigerating cylinder 21 is below the predetermined temperature while is turned off when the temperature of the refrigerating cylinder 21 is not less than the predetermined temperature.

Connected to the lower portion of the refrigerating cylinder 21 are an outlet of a water supply pipe 31 and an inlet of a drain pipe 32. The inlet of the water supply pipe 31 is connected to the bottom surface of a water supply tank 33. The drain pipe 32 is provided with a drain valve 34 composed of an electromagnetic valve and is open to a drain pan 35. The drain valve 34 is closed when it is deenergized, while opened when it is energized.

Tap water is selectively supplied to the water supply tank 33 from a water pipe 37 provided with a water supply valve 36 composed of an electromagnetic valve. The water supply valve 36 is closed when it is deenregized, while opened when it is energized. The water supply tank 33 has accommodated therein a float switch assembly 38 provided with an upper float switch 38*a* and a lower float switch 38*b*. The upper float switch 38*a* is in an off-state when the water level in the water supply tank 30 falls below an upper limit level, while it is turned on when the water level rises above the upper limit level. The lower float switch 38*b* is in an off-state when the water level in the water supply tank 30 falls below a lower limit level, while it is turned on when the water level rises above the lower limit level. The water supply tank 33 is further provided with an overflow pipe 39 that is open to the drain pan 35 for preventing the overflow from the tank 33.

Figure 2:
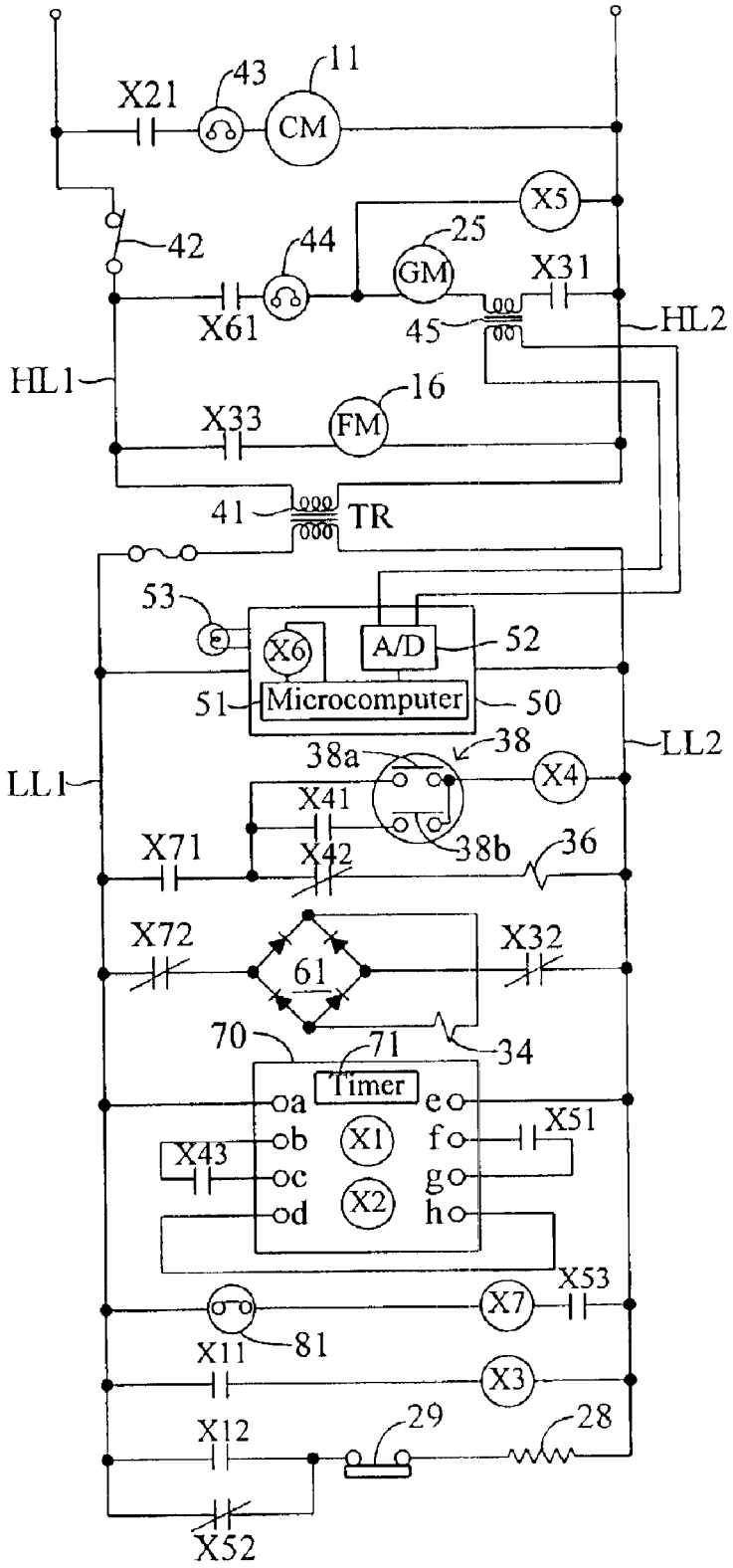
FIG. 2 is an electric circuit diagram of the auger-type ice making machine.

Subsequently explained is an electric circuit assembly of the auger-type ice making machine having the above-mentioned configuration. This electric circuit assembly has, as shown in FIG. 2, a pair of high-voltage power supply lines HL1 and HL2 and a pair of low-voltage power supply lines LL1 and LL2. Supplied externally between the high-voltage power supply lines HL1 and HL2 is high-voltage alternating-current power via a plug socket not shown. Supplied between the low-voltage power supply lines LL1 and LL2 is low-voltage alternating-current power via a transformer 41 that is connected between the high-voltage power supply lines HL1, HL2 and the low-voltage power supply lines LL1, LL2.

A relay switch X21, overcurrent breaker 43 and compressor 11 are connected in series between the high-voltage power supply lines HL1 and HL2 at the upstream side with respect to a main switch 42 used for starting the ice making operation by the auger-type ice making machine. The overcurrent breaker 43 is always in an on-state but is turned off for protecting the compressor 11 when the overcurrent flows over a predetermined period. The relay switch X21 is composed of a normally open type switch. This relay switch X21 is in an off-state when a relay coil X2 described later is deenergized, while it is turned on upon energizing the coil X2.

A relay switch X61, overcurrent breaker 44, auger motor 25, primary coil of a current-voltage converter 45 and relay switch X31 are connected in series between the high-voltage power supply lines HL1 and HL2 at the downstream side with respect to the main switch 42. The relay switches X61 and X31 are composed of normally open type switches. These switches are in an off-state when relay coils X6 and X3 described later are deenergized, while they are turned on upon energizing the coils X6 and X3. The overcurrent breaker 44 is always in an on-state but is turned off for protecting the auger motor 25 when the overcurrent flows over a predetermined period. The current-voltage converter 45 produces voltage in proportion to the current flowing through the auger motor 25 on a secondary coil and outputs the resultant. Further, a relay coil X5 is connected in parallel to a series circuit composed of the auger motor 25, the primary coil of the current-voltage converter 45 and the relay switch X31.

A relay switch X33 and a fan motor 16 are also connected in series between the high-voltage power supply lines HL1 and HL2 at the downstream side with respect to the main switch 42. The relay switch X33 is composed of a normally open type switch. This switch is in an off-state when the relay coil X3 described later is deenergized, while it is turned on upon energizing the coil X3.

A controller board 50 having installed thereon a microcomputer 51, A/D converter 52 and a relay coil X6 is connected between the low-voltage power supply lines LL1 and LL2. The microcomputer 51 is composed of a CPU, ROM, RAM, timer or the like. It starts the execution of a program shown in flowcharts in FIGS. 3 and 4 upon the start of the power supply for detecting the overcurrent to the auger motor 25, thereby controlling the operation of the auger-type ice making machine. The A/D converter 52 converts analog voltage supplied from the secondary coil of the current-voltage converter 45 into digital value and supplies the resultant to the microcomputer 51. The relay coil X6 is on/off controlled by the microcomputer 51. It is to be noted that these of the microcomputer 51, A/D converter 52 and relay coil X6 are activated by direct-current power supplied from a voltage regulator that is not shown and incorporated into the controller board. Connected also to this controller board is an alarm lamp 53 that is lighted upon detecting the overcurrent to the auger motor 25.

A relay switch X71, relay switch X42 and water supply valve 36 are also connected in series between the low-voltage power supply lines LL1 and LL2. The relay switch X71 is composed of a normally open type switch. This switch is in an off-state when a relay coil X7 described later is deenergized, while it is turned on upon energizing the coil X7. The relay switch X42 is composed of a normally close type switch. This switch is in an on-state when a relay coil X4 described later is deenergized, while it is turned off upon energizing the coil X4.

Connected in parallel to a series circuit comprising the relay switch X42 and the water supply valve 36 is a series circuit composed of the upper float switch 38*a* of the float switch assembly 38 and the relay coil X4. Connected in parallel to the upper float switch 38*a* is a series circuit composed of the relay switch X41 and the lower float switch 38*b* of the float switch assembly 38. The relay switch X41 is composed of a normally open type switch. This switch is in an off-state when the relay coil X4 described later is deenergized, while it is turned on upon energizing the coil X4.

A relay switch X72, diode bridge circuit 61 and relay switch X32 are also connected in series between the low-voltage power supply lines LL1 and LL2. The relay switches X72 and X32 are composed of normally close type switches. They are in an on-state when the relay coils X7 and X3 described later are deenergized, while they are turned off upon energizing the coils X7 and X3. The diode bridge 61 is provided for a rectification. The drain valve 34 is connected to a diagonal position of the bridge 61 different from the diagonal position thereof to which the relay switches X72 and X32 are connected.

A timer board 70 is also connected between the low-voltage power supply lines LL1 and LL2. The timer board 70 is provided with a timer 71 and relay coils X1 and X2 as well as has a relay switch X43 and a relay switch X51 connected between b and c terminals of the board 70 and between f and g terminals thereof respectively. The relay switches X43 and X51 are composed of normally open type switches. They are in an off-state when the relay coils X4 and X5 described later are deenergized, while they are turned on upon energizing the coils X4 and X5.

On this timer board 70, the relay coil X1 is energized immediately after the relay switch X43 is turned on to provide continuity between the b and c terminals, and then, the relay coil X2 is energized by the operation of the timer 71 after a lapse of a predetermined time (for example, 60 seconds) from the energization to the relay coil X1. When the relay switch X43 is turned off to release the continuity between the b and c terminals, the relay coil X2 is deenergized by the, operation of the timer 71 after a lapse of a predetermined time (for example, 60 seconds) after the release of the continuity, and then, the relay coil X1 is deenergized by the operation of the timer 71 after a lapse of a predetermined time (for example, 90 seconds) from the deenergization of the relay coil X2. Further, only the relay coil X2 is deenergized immediately after only the relay switch X51 is turned off to release continuity between f and g terminals. The deenergization state of the relay coil X2 is maintained irrelevant to the continuity and the release of the continuity between b and c terminals upon the release of the continuity between f and g terminals.

An ice storage switch 81, relay coil X7 and relay switch X53 are also connected in series between the low-voltage power supply switches LL1 and LL2. The ice storage switch 81 is mounted in the ice storage bin not shown. This switch 81 is in an on-state when the ice storage bin is not filled with produced ice, while it is turned on when the ice storage bin is filled with produced ice. The relay switch X53 is composed of a normally open type switch. This switch is in an off-state when the relay coil X5 is deenergized, while it is turned on upon energizing the coil X5.

A relay switch X11 and the relay coil X3 are also connected in series between the low-voltage power supply lines LL1 and LL2. The relay switch X11 is composed of a normally open type switch. This switch is in an off-state when the relay coil X1 is deenergized, while it is turned on upon energizing the coil X1.

A relay switch X12, the thermostat 29 and the thawing heater 28 are also connected in series between the low-voltage power supply lines LL1 and LL2. The relay switch X12 is composed of a normally open type switch. This switch is in an off-state when the relay coil X1 is deenergized, while it is turned on upon energizing the coil X1. A relay switch X52 is connected in parallel to the relay switch X12. The relay switch X52 is composed of a normally close type switch. This switch is in an on-state when the relay coil X5 is deenergized, while it is turned off upon energizing the coil X5.

Subsequently explained is an operation of the auger-type ice making machine thus configured. When the main switch 42 is turned on with the high-voltage power supplied to the high-voltage power supply lines HL1 and HL2 at the upstream side with respect to the main switch 42 by connecting to a plug socket not shown, the high-voltage power is also supplied to the high-voltage power supply lines HL1 and HL2 at the downstream side with respect to the main switch 42 as well as the low-voltage power is supplied to the low-voltage power supply lines LL1 and LL2 via the transformer 41. This enables to start a power supply to the controller board 50, whereby the microcomputer 51 mounted on the board 50 starts the execution of the program at a step 100 shown in FIG. 3 after a predetermined initial processing, and then, energizes the relay coil X6 by the processing at a step 108 described later.

The relay switch X61 is turned on by the energization to the relay coil X6, resulting in that current flows through the relay coil X5 via the overcurrent breaker 44. This turns on the relay switch X53, thereby energizing the relay coil X7 on the condition that the ice storage switch 81 is turned on, i.e., that the ice storage bin not shown is not filled with ice. Assuming that the ice storage bin is now not filled with ice, the relay coil X7 is energized to thereby turn on the relay switch X71. The water supply valve 36 is selectively energized with the relay switch X71 turned on depending upon the state (on-state or off-state) of the relay switch X42 that is on/off controlled by the relay coil X4.

The energization and deenergization of the relay coil X4 are controlled by the upper float switch 38*a* and the lower float switch 38*b*. When the water level in the water supply tank 33 falls below the lower limit level, both of the float switches 38*a* and 38*b* are turned off, so that the relay coil X4 is not energized. With the relay coil X4 deenergized, the relay switch X42 is turned on, whereby the water supply valve 36 is energized to be opened. Accordingly, tap water is supplied to the water supply tank 33 via the water pipe 37, with the result that the water level in the tank 33 rises. When the water level rises above the lower limit level by this rise of the water level, the lower float switch 38*b* is turned on, but the relay coil X4 remains deenergized since the relay switch X41 is in the off-state.

When the water level in the water supply tank 33 rises further by the supply of the tap water to exceed the upper limit level, the upper float switch 38*a* is turned on to thereby energize the relay coil X4. The energization to the relay coil X4 turns off the relay switch X42 that has been in the on-state, thereby deenergizing the water supply valve 36. By this, the water supply valve 36 is closed, so that the supply of the tap water to the water supply tank 33 is stopped. On the other hand, the relay switch X41 is changed to the on-state by the energization to the relay coil X4, since the lower float switch 38*b* is kept to be the on-state as described above. By the on-state of the relay switch X41, the energization to the relay coil X4 is maintained until the lower float switch 38*b* is turned off, whereby the water supply valve 36 remains closed.

The relay switch X43 is changed to the on-state by the above-mentioned energization to the relay coil X4. This change-over of the relay switch X43 provides continuity between b and c terminals of the timer board 70, resulting in that the relay coil X1 is immediately energized to change the relay switch X11 to the on-state. This energizes the relay coil X3, whereby the relay switches X31 and X33 are changed to the on-state. This change-over of the relay switch X31 to the on-state causes to supply the high-voltage alternating-current power to the auger motor 25, with the result that the auger motor 25 starts the rotational operation. The rotational torque of the auger motor 25 is transmitted to the ice-scraping auger 23 via the reduction gear 24, whereby the ice-scraping auger 23 starts to rotate coaxially. Further, the relay switch X33 is changed to the on-state by the change-over of the relay switch X33 to the on-state. This change-over of the relay switch X33 to the on-state also causes to supply the high-voltage alternating-current power to the fan motor 16, with the result that the fan motor 16 starts the rotational operation, and hence, the fan 17 starts to rotate.

Moreover, the energization to the relay coil X1 changes the relay switch X12 into the on-state, whereby the thawing heater 28 is also energized so long as the thermostat 29 is kept to be in the on-state. This causes the thawing heater 28 to maintain the press head assembly 26 to a predetermined temperature or above in cooperation to the thermostat 29, so that the produced ice described later is easily scraped off the press head assembly 26.

The relay coil X2 is also energized after a lapse of a predetermined time (for example, 60 seconds) after the energization to the relay coil X1. The energization to the relay coil X2 changes the relay switch X21 into the on-state, with the result that the refrigerant compressor 11 starts to activate. This causes the high-temperature and high-pressure refrigerant ejected from the refrigerant compressor 11 to start to circulate in the refrigerant circuit system 10 comprised of the condenser 12, dryer 13, expansion valve 14 and evaporation pipe 15.in the direction shown by the broken lines in FIG. 1. The evaporation pipe 15 cools the refrigerating cylinder 21 by the circulation of the refrigerant. The water for ice-making is supplied to the refrigerating cylinder 21 from the water supply tank 33 via the water supply pipe 31 with this state, so that ice is produced at the inner peripheral surface of the cylinder 21. The produced ice is scraped by the rotation of the auger 23 and the consequent rotation of the spiral blade 23*a* to thereby be fed upwardly, transformed into flake-like pieces by the operation of the press head assembly 26, and then, discharged to the discharge cylinder 27.

When the water in the water supply tank 33 is consumed by the above-mentioned ice making operation and as a result, the water level in the tank 33 falls below the lower limit level, both of the float switches 38*a* and 38*b* are turned off as described above for deenergizing the relay coil X4. This changes the relay switch X42 into the on-state like the above-mentioned case, whereby the water supply valve 36 is energized to be opened. Therefore, the tap water is supplied again to the water supply tank 33 from the water pipe, with the result that the water level in the tank 33 starts to rise again.

On the other hand, when the relay coil X4 is deenergized with the water level in the water supply tank 33 rising above the upper limit level, the relay switch X43 is changed from the on-state to the off-state. However, the deenergization of the relay coils X1 and X2 is delayed by a predetermined time (for example, 60 seconds for the relay coil X2 and 90 seconds for the relay coil X2) by the operation of the timer 71. Unless the abnormality in supplying the tap water such as the case where water supply is cut off occurs during this delay, the tap water is supplied to the water supply tank 33, whereby the water level in the tank 33 reaches the upper limit level. Accordingly, the relay switch X4 is re-energized before the relay coils X1 and X2 are deenergized, with the result that the energization to the relay coils X1 and X2 is continued to keep activating the refrigerant compressor 11, auger motor 25 and fan motor 16, which means the continuation of the ice making operation. Consequently, unless the abnormality in supplying the tap water such as the case where water supply is cut off occurs, the water level in the water supply tank 33 is always maintained between the lower limit level and the upper limit level, so that the ice making operation is continued.

If the abnormality in supplying the tap water such as the case where water supply is cut off occurs, the water level in the water supply tank 33 does not reach the upper limit level even after a lapse of a predetermined time after the relay switch X43 is changed from the on-state to the off-state as described above. In this case, the relay coil X2 is deenergized at the time when the predetermined time has been elapsed. This changes the relay switch X21 from the on-state to the off-state, thereby halting the operation of the refrigerant compressor 11. Since the relay coil X1 is deenergized after a lapse of a predetermined time from the deenergization of the relay coil X2, the relay switch X11 is changed from the on-state to the off-state to thereby also deenergize the relay coil X3. This changes the relay switches X31 and X33 from the on-state to the off-state, thereby halting the operations of the auger motor 25 and the fan motor 16. Consequently, the refrigerant compressor 11, auger motor 25 and fan motor 16 are protected in the case of the abnormality in supplying the tap water such as the case where water supply is cut off.

In case where the ice storage bin is filled with ice by the above-mentioned ice making operation, the ice storage switch 81 is changed from the on-state to the off-state, thereby deenergizing the relay coil X7. By the deenergization of the relay coil X7, the relay switch X71 is changed from the on-state to the off-state to thereby deenergize the relay coil X4, whereby the relay switch X43 is changed from the on-state to the off-state like the above-mentioned case. It is to be noted that, since the relay switch X71 is kept to be in the off-state in this case, the water supply valve 36 is closed, so that the water supply to the water supply tank 33 remains stopped. Accordingly, the relay coil X4 is not energized even if the predetermined time has been elapsed after the relay switch X71 is changed to the off-state. This continues the off-state of the relay switch X43 over the predetermined time, thereby deenergizing the relay coils X1 and X2. As a result, the operations of the refrigerant compressor 11, auger motor 25 and fan motor 16 are halted to thereby temporarily stop the ice making operation like the above-mentioned case.

When the ice in the ice storage bin is consumed to bring the ice storage switch 81 into the on-state in this case, the relay coil X7 is re-energized to change the relay switch X71 from the off-state to the on-state. Consequently, the tap water is supplied to the water supply tank 33 as described above, whereby the water level in the water supply tank 33 is always maintained between the lower limit level and the upper limit level to thereby restart the ice making operation.

Figure 3:
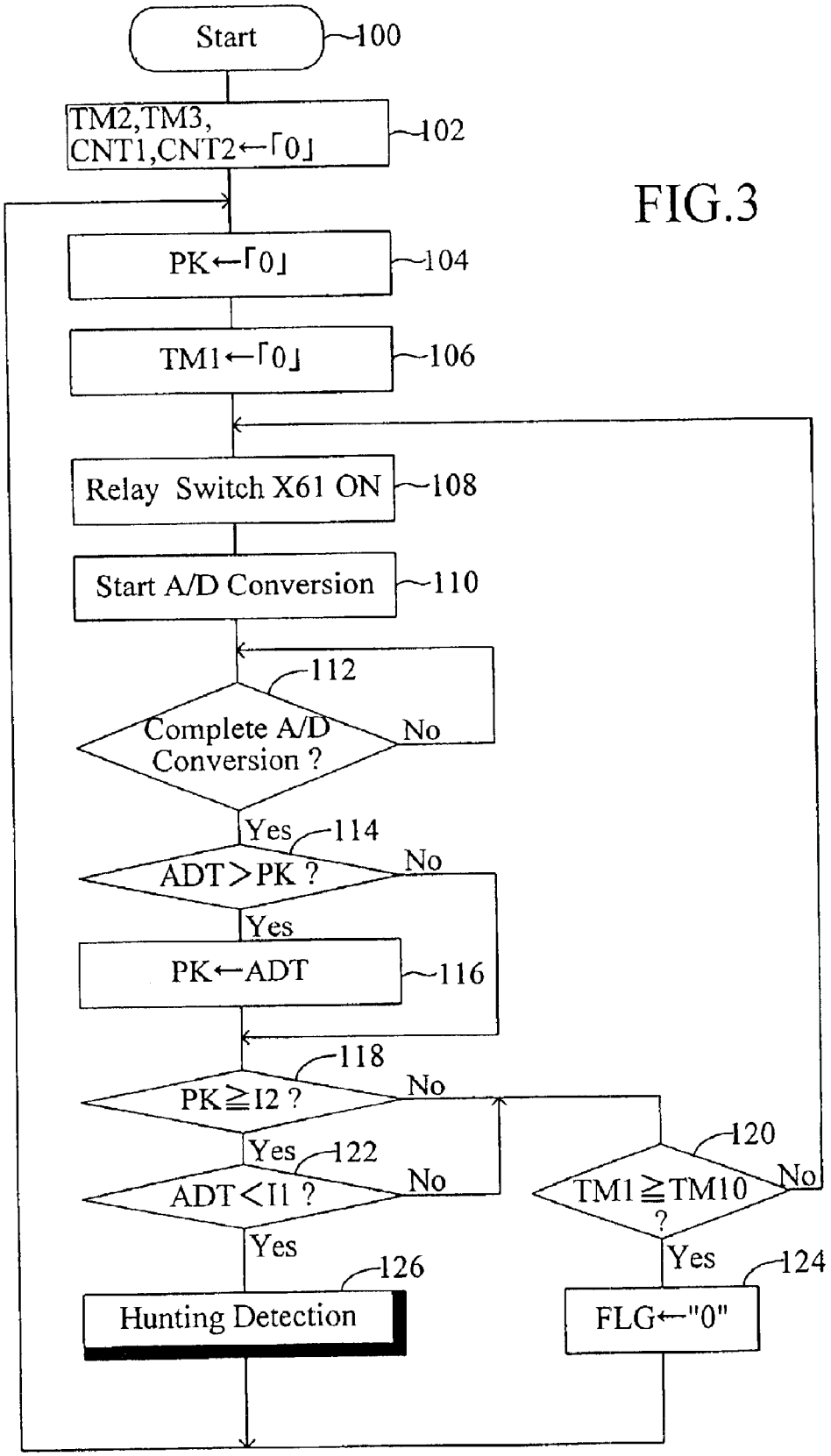
FIG. 3 is a flowchart showing a program executed by a microcomputer shown in FIG. 2.
Figure 4:
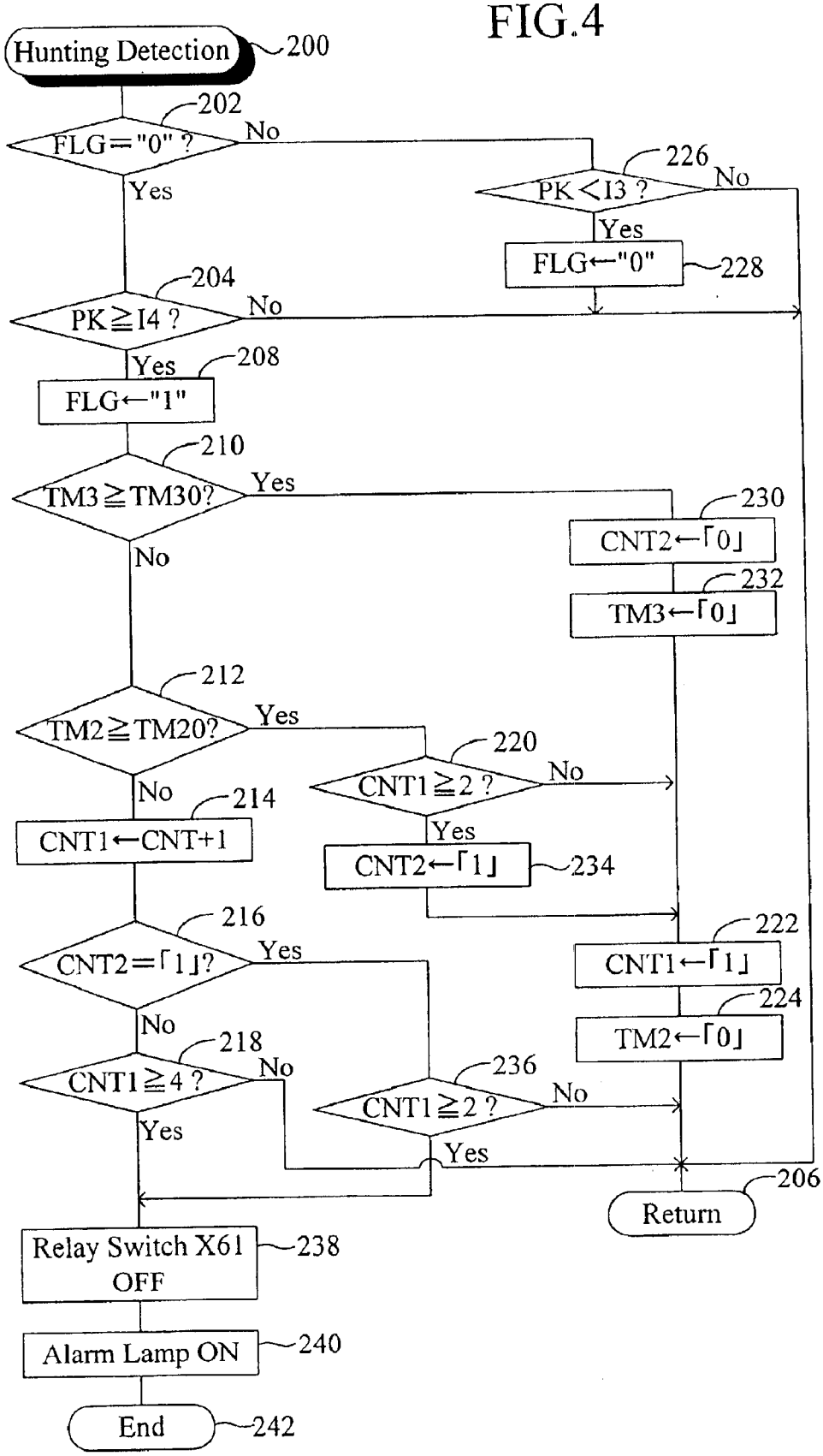
FIG. 4 is a flowchart showing a detail of a hunting detection routine in FIG. 3.

As described above, the microcomputer 51 executes the initialization in response to the power-on of the main switch 42, and after the initialization, executes programs shown in FIGS. 3 and 4 in synchronism with the above-mentioned ice making operation of the auger-type ice making machine. This program is started to be executed at a step 100. At a step 102, time count values TM2 and TM3 are initialized to "0" respectively and first and second number of times count values CNT1 and CNT2 are initialized to "0" respectively. Subsequently, a peak value PK is initialized to "0" at a step 104, and a time count value TM1 is initialized to "0" at a step 106. The time count value TM1 represents a counted value of an elapsed time by a timer, which is utilized for detecting the peak value PK (amplitude value) of AC current flowing through the auger motor 25. The time count values TM2 and TM3 represent counted values of an elapsed time by the timer, which are utilized for detecting a hunting of the peak value PK. The first and second number of times count values CNT1 and CNT2 represent a number of hunting times of the peak value PK. The peak value PK is utilized for detecting the maximum value (amplitude value) of each half-wave of the AC current flowing through the auger motor 25 and represents the maximum value of the half-wave after the detection of the maximum value is completed.

After the initializations at steps 102 to 106, the relay coil X6 is energized at a step 108. The relay switch X61 is set to the on-state by this energization, thereby promoting to start the operation of the auger-type ice making machine as described above by the processing at the step 108 upon the power-on of the main switch 42. The energization to the relay coil X6 is maintained even after the processing at the step 108 is executed.

Subsequently, a step 110 instructs the start of AND conversion to the A/D converter 52. The A/D converter 52 sample-holds a voltage value from the current-voltage converter 45 in response to the instruction of the start and starts the A/D conversion of the sample-held voltage value. This voltage value represents an instantaneous value of the current flowing through the auger motor 25. After the processing at the step 110, a step 112 makes "NO" determination to stand by until the A/D conversion by the A/D converter 52 is completed. After the completion of the A/D conversion, the step 112 makes "YES" determination and the program proceeds to a step 114. At the step 114, the voltage value that is A/D converted from the A/D converter 52 is inputted to be set as the instantaneous value ADT and compares the instantaneous value ADT to the peak value PK. If the instantaneous value ADT is greater than the peak value PK as a result of this comparison, the step 114 makes "YES" determination to renew the peak value PK to the instantaneous value ADT at a step 116, and then the program proceeds to a step 118. If the instantaneous value ADT is not greater than the peak value PK, "NO" determination is made and the program directly proceeds to the step 118.

At the step 118, the peak value PK is compared to a small predetermined current value I2 (for example, 1.0 A). If the peak value PK is less than the predetermined current value I2, the program proceeds to a step 120 that determines whether the time count value TM1 is not less than a predetermined time value TM10 or not. This predetermined time value TM10 is set at least to a time (for example, 1 second) longer than one cycle of the waveform of the AC current flowing through the auger motor as well as suitable for detecting that AC current is not flowing through the auger motor 25.

If AC current is not flowing through the auger motor 25, the peak value PK is approximately "0", thereby obtaining "NO" determination at the step 118. Further, unless a time corresponding to the predetermined time value TM10 has been elapsed from the start of the execution of the program, "NO" determination is made at the step 120. Therefore, a circular processing from the step 108 to the step 120 is kept executing in this case. After the lapse of the time corresponding to the predetermined time value TM10, "YES" determination is made at the step 120, a flag FLG is set to "0" at a step 124, and then the program returns to the step 104 for executing the processings at the step 104 and the following steps. Accordingly, with the AC current not flowing through the auger motor 25, the circular processing from the step 108 to the step 120 is kept executing, and the processings at the steps 104 to 120 and at the step 124 are executed every time corresponding to the predetermined time value TM10, whereby the flag FLG is set to "0". The flag FLG is utilized for detecting the hunting of the current flowing through the auger motor 25. The value "0". thereof represents that the peak value PK of the AC current flowing through the auger motor 25 becomes lower than the predetermined current value I3 (for example, 4 A), while the value "1" thereof represents that the peak value PK becomes not less than a predetermined current value I4 (for example, 5 A) that is greater than the predetermined current value I3.

Figure 5A:
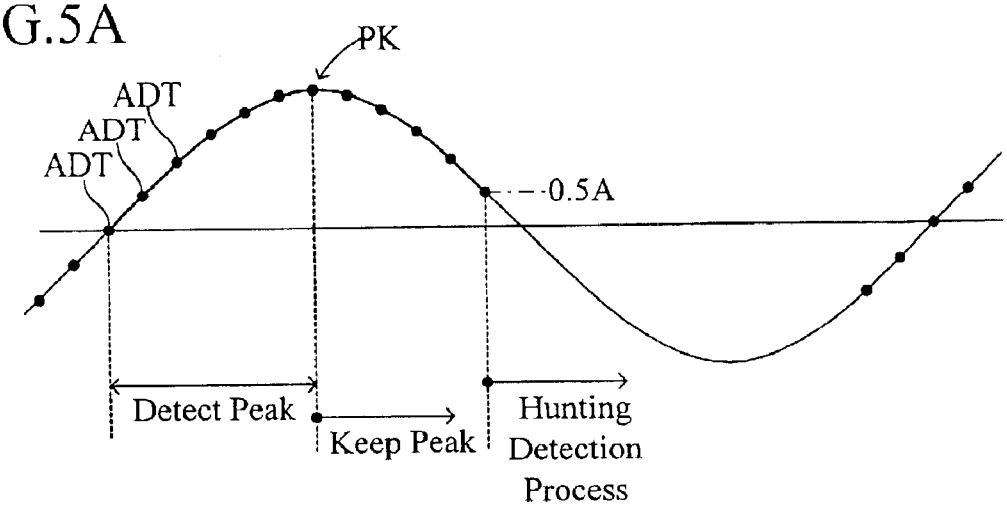
FIG. 5A is a waveform chart showing one waveform taken out from a waveform of AC current flowing through an auger motor.

When the AC current starts to flow through the auger motor 25, the instantaneous value ADT of the AC current taken from the AND converter 52 repeats a rising and falling as shown in FIG. 5A. Accordingly, the peak value PK renewed at the step 116 becomes gradually greater from "0" at a rising portion of a positive half-wave during the circular processing from the step 108 to step 120. In a negative half-wave portion of an alternating current signal, "YES" determination is not made at the step 114 and the peak value PK is not renewed by the processing at the step 116, since the peak value PK is initialized to "0" by the processing at the step 104. When the peak value PK is not less than the predetermined current value I2, "YES" determination is made at the step 118 followed by executing the determination processing at a step 122. At the step 122, the instantaneous value ADT is compared to a small predetermined value I1. The predetermined current value I1 is set to a value smaller than the predetermined current value I2, for example, set to 0.5 A. Therefore, the instantaneous value ADT is not less than the predetermined current value I1 at least with the peak value PK increasing, whereby "NO" determination is made at the step 122, and then, the circular processing of steps 108 to 118, 122 and 120 is kept executing.

During the circular processing of the steps 108 to 118, 122 and 120, the peak value PK successively increases. When the instantaneous value of the AC current reaches the maximum value (peak) and then starts to decrease, the step 114 makes "NO" determination, i.e., it determines that the instantaneous value ADT is not more than the peak value PK. Therefore, the processing at the step 116 is not executed with this state, whereby the circular processing composed of the steps 108 to 114, 118. 122 and 120 is kept executing to thereby maintain the peak value PK at the maximum value (peak value) of the positive half-wave of the AC current.

When the instantaneous value ADT is less than the predetermined current value I1 by the reduction in the instantaneous value of the AC current, "YES" determination is made at the step 122, and then, the program proceeds to a hunting detection routine at a step 126. Accordingly, as shown in FIG. 5A, when the peak value (amplitude value) PK of the AC current is detected at the rising portion of the positive half-wave of the alternating current signal and after that, the instantaneous value ADT of the alternating current signal becomes less than the predetermined current value I1 with this detected peak value kept unchanged, the hunting detection routine is executed with this peak value PK kept unchanged.

After the execution of this hunting detection routine, the program returns to the step 104 for executing again the processings at the steps 104 and 106. Thereafter, the circular processing of steps 108 to 120, the circular processing of steps 108 to 118, 122 and 120 and the circular processing of steps 108 to 114, 118, 122 and 120 are executed to detect the next maximum value (peak value) of the positive half-wave of the AC current. Since the frequency of the AC current is 50 Hz or 60 Hz and the time required for detecting the peak value is approximately 20 milliseconds or 16 milliseconds, the timer count value TM initialized to "0" by the processing at the step 106 does not reach the predetermined time value TM10, whereby the processing at the step 124 is not executed. Consequently, the flag FLG is set to "0" at the initialization, but since then, keeps the value renewed at the hunting detection routine described later .

Figure 5B:
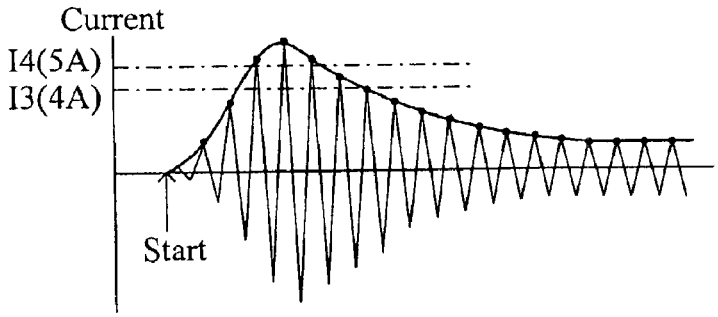
FIG. 5B is a waveform chart of AC current flowing through the auger motor upon starting to operate the auger motor.

Subsequently explained is a hunting detection operation of the peak value PK of the AC current flowing through the auger motor 25 by the hunting detection routine together with the activating state of the motor 25. Firstly explained is the case where the auger motor 25 is normally operated to thereby continue the ice making operation. As shown in FIG. 5B, great rush current flows through the auger motor 25 upon starting the operation of the motor 25, and after that, this current gradually decreases to become steady-state current.

The execution of the hunting detection routine starts from a step 200 in FIG. 4. The flag FLG is determined to be "0" or not at a step 202. If the flag FLG is "0" as described above, the step 202 makes "YES" determination, and then, a step 204 determines whether the peak value PK is not less than the predetermined current value I4 (for example, 5 A) or not. If it is shortly after the start of the operation of the auger motor 25 and further, the peak value PK is less than the predetermined current value I4, "NO" determination is made at the step 204, and then, the execution of the hunting detection routine is completed at a step 206.

On the other hand, when the rush current starts to flow through the auger motor 25 due to the lapse of time, and consequently the peak value PK is not less than the predetermined current value I4, the step 204 makes "YES" determination and a step 208 sets the flag FLG to "1". Subsequently, a step 210 determines whether the time count value TM3 is not less than the predetermined time value TM30 (for example, 3 minutes) or not. Since great rush current starts to flow through the auger motor 25 during a short period from the start of its operation in this case, the time count value TM3 initialized to "0" by the processing at the step 102 is less than the predetermined time value TM30, so that "NO" determination is made at the step 210, and then, a step 212 determines whether the time count value TM2 is not less than a predetermined time value TM20 (for example, 20 seconds) or not.

In this case too, the time count value TM2 initialized to "0" by the processing at the step 102 is less than the predetermined time value TM20, so that "NO" determination is made at the step 212, and then, "1" is added to the first number of times count value CNT1 at a step 214. This first number of times count value CNT1 becomes "1" by this adding processing since it has been set to "0" by the initialization at the step 102.

Subsequently, a step 216 determines whether the second number of times count value CNT2 is "1" or not. The second number of times count value CNT2 remains "0" that is set by the initialization at the step 102, so that "NO" determination is made at the step 216, and then, the program proceeds to a step 218. The step 218 determines whether the first number of times count value CNT1 is not less than 4 or not. Since the first number of times count value CNT1 is "1" as described above, the step 218 makes "NO" determination, and then, the step 206 terminates the execution of this hunting detection routine.

In case where a time (for example, 20 seconds) corresponding to the predetermined time value TM20 has been elapsed by the time when great rush current starts to flow through the auger motor 25, which means that the time count value TM2 is not less than the predetermined time value TM20, the step 212 makes "YES" determination, and the program proceeds to a step 220. The step 220 determines whether the first number of times count value CNT1 is not less than 2 or not. Since the first number of times count value CNT1 is "1" as described above, the step 220 makes "NO" determination, and the program proceeds to steps 222 and 224. The first number of times count value CNT1 is set to "1" at the step 222, while the time count value TM2 is set to "0" at the step 224. Then, the execution of the hunting detection routine is completed at the step 206.

On the other hand, if the flag FLG is set to "1" as described above, the step 202 makes "NO" determination to proceed to the step 226 when this hunting detection routine is executed next time. The step 226 determines whether the peak value PK is less than the predetermined current value I3 (for example, 4 A) or not that is smaller than the predetermined current value I4 (for example, 5 A). If the peak value PK is still kept to a value not less than the predetermined current value I3 in this case, the step 226 makes "NO" determination, and then, the step 206 temporarily terminates this hunting detection routine.

When the peak value PK becomes less than the predetermined current value I3 because of the attenuation in the rush current due to the lapse of time, the step 226 makes "YES" determination to proceed to a step 228. At the step 228, the flag FLG is returned to "0", followed by temporarily terminating this hunting detection routine at the step 206. As the flag FLG is returned to "0" as described above, "YES" determination is made at the step 202, and the program proceeds again to the step 204 and the following steps. However, unless great current flows through the auger motor 25 after the attenuation in the rush current, the peak value PK does not take a value not less than the predetermined current value I4, whereby the step 204 continues to make "NO" determination, and the step 206 terminates the execution of the hunting detection routine.

As a result, even if great rush current flows through the auger motor 25, the alternating current power is continuously supplied to the motor 25 so long as this rush current attenuates after that, resulting in that the motor 25 keeps operating. Therefore, the above-mentioned ice making operation is continued.

Figure 5C:
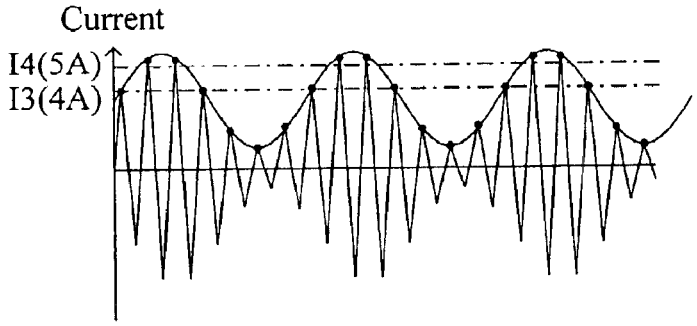
FIG. 5C is a waveform chart of AC current flowing through the auger motor when a hunting occurs.

Subsequently explained is the case where the ice-scraping auger 23 starts to freeze to the refrigerating cylinder 21 due to the overgrowth of ice therein, and consequently, the ice-scraping auger 23 starts to become unrotatable. In this case, a load to the auger motor 25 starts to greatly fluctuate. By this, the peak value PK of the AC current flowing through the auger motor 25 starts to vibrate, i.e, starts to hunt as shown in FIG. 5C.

When the peak value PK becomes not less than the predetermined current value I4 due to this hunting, the step 204 makes "YES" determination, and then, the step 208 sets the flag FLG to "1" for executing the determination processing of the step 210. In this case, a time not less than the time (for example, 3 minutes) corresponding to the predetermined time value TM30 is elapsed from the start of the operation of the auger motor 25. Therefore, the step 210 makes "YES" determination, a step 230 initializes the second number of times count value CNT2 to "0" and a step 232 initializes the time count value TM3 to "0". Subsequently, the step 222 sets the first number of times count value CNT1 to "1", the step 224 initializes the time count value TM2 to "0" and the step 206 temporarily terminates this hunting detection routine.

When this hunting detection routine is re-executed, "NO" determination is made at the step 202 based upon the above-mentioned flag FLG set to "1", whereupon the program proceeds to the determination processing at the step 226. "NO" determination is made in the determination processing at the step 226 in case where the peak value PK is not less than the predetermined current value I3 as described above, whereupon the program proceeds to the step 206. However, if the peak value PK becomes less than the predetermined current value I3 due to the above-mentioned hunting, "YES" determination is made and the flag FLG is returned to "0" at the step 228. Therefore, when this hunting detection routine is re-executed, "YES" determination is made at the step 202 for executing the processings at the step 204 and the following steps.

If the peak value PK is less than the predetermined current value 14 in this case, the step 204 makes "NO" determination to proceed to the step 206. However, if the peak value PK again becomes not less than the predetermined current value I4 due to the hunting, the step 204 makes again "YES" determination followed by setting the flag FLG to "1" at the step 208, and then, the program proceeds to the step 210. Unless the time (for example, 3 minutes) corresponding to the predetermined time value TM30 has been elapsed from the initialization of the time count value TM3 at the step 232, the step 210 makes "NO" determination to proceed to the step 212. If the time corresponding to the predetermined time value TM3 has been elapsed, the step 210 makes "YES" determination for executing the above-mentioned initializations at steps 230, 232, 222 and 224.

Unless the time (for example, 20 seconds) corresponding to the predetermined time value TM2 has been elapsed from the initialization of the time count value TM2 at the step 224, the step 212 makes "NO" determination, and then, "1" is added to the first number of times count value CNT1 at a step 214. If the second number of times count value CNT2 is not "1" as a result of the determination processing of the step 216, "NO" determination is made at the same step 216, whereupon the step 218 determines whether the first number of times count value CNT1 is not less than "4" or not. If the first number of times count value CNT1 is less than 4 in this case, the step 218 makes "NO" determination to proceed to the step 206. However, if the first number of times count value CNT1 that is subject to the adding processing at the step 214 is not less than "4" by the hunting, the step 218 makes "YES" determination to proceed to a step 238.

According to this hunting detection process, when the peak value PK rises from the state less than the predetermined current value I3 to the state not less than the predetermined current value I4 four times during the time (for example, 20 seconds) corresponding to the predetermined time value TM20, the processings at the step 238 and the following steps are executed. Specifically, when the peak value PK of the AC current flowing through the auger motor 25 hunts four times during the time corresponding to the predetermined time value TM20, the processings at the step 238 and the following steps are executed.

Even after a lapse of the time corresponding to the predetermined time value TM20 after the time count value TM2 is initialized to "0" at the step 224, "NO" determination is made at the step 210, "YES" at the step 212, "YES" at the step 220, the second number of times count value CNT2 is set to "1" at the step 234, and then, the initializations at the steps 222 and 224 are executed, so long as it is before a lapse of the time corresponding to the predetermined time value TM30 after the time count value TM3 is initialized to "0" at the step 232 as well as the first number of times count value CNT1 that is subject to the adding processing at the step 214 is not less than 2.

When the peak value PK rises from the value less than the predetermined current value I3 to the value not less than the predetermined current value I4 during the time (for example, 20 seconds) corresponding to the predetermined time value TM20 from these initializations, the first number of times count value CNT1 is to be set to "2" by the processing of the step 214. In this case, the step 216 makes "YES" determination., the step 236 also makes "YES" determination, i.e., determines that the first number of times count value CNT1 is not less than "2", and then, the program proceeds to the step 238.

According to this hunting detection process, also in the case where the state that the peak value PK rises twice from the state less than the predetermined current value I3 to the state not less than the predetermined current value I4 during the time (for example, 20 seconds) corresponding to the predetermined time value TM20 is repeated twice during the time (for example, 3 minutes) corresponding to the predetermined time value TM30, the processings at the step 238 and the following steps are executed. Specifically, when the state where the hunting of the peak value PK of the AC current flowing through the auger motor 25 occurs twice during the time corresponding to the predetermined time value TM20 is repeated twice during the time corresponding to the predetermined time value TM30, the processings at the step 238 and the following steps are executed.

The relay coil X6 is deenergized at the step 238. Thereafter, the alarm lamp 53 is lighted at the step 240 and the execution of the program is completed at the step 242. The programs shown in FIGS. 3 and 4 are not re-executed so long as the main switch 42 is newly turned on.

The relay switch X61 is turned off due to the deenergization of the relay coil X6, so that the auger motor 25 is deenergized to stop the operation of the motor 25. Further, the relay coil X5 is deenergized by turning off the relay switch X61 to thereby turn off the relay coil X51, whereby the continuity between f and g terminal of the timer board 70 is released to thereby immediately deenergize the relay coil X2. This also turns off the relay switch X21, so that the refrigerant compressor 11 is deenregized to stop its operation. By this, the operations of the auger motor 25 and the refrigerant compressor 11 are immediately stopped when the above-mentioned hunting of the AC current flowing through the auger motor 25 is detected.

The relay coil X53 is turned off due to the deenergization of the relay coil X5, so that the relay coil X7 is deenergized. The relay switch X71 is turned off due to the deenergization of the relay coil X7, whereby the water supply valve 36 and the relay coil X4 are also deenergized. This closes the water supply valve 36, with the result that the water supply to the water supply tank 33 is terminated irrespective of the water level in the tank 33.

The relay switch X43 is turned off due to the above-mentioned deenergization of the relay coil X4, thereby releasing the continuity between b and c terminals of the timer board 70. Since the relay coil X2 has already been deenergized, the relay coil X1 is deenergized after a predetermined time (for example, 90 seconds) from the release of the continuity between b and c terminals by the operation of the timer 71. The relay switch X11 is turned off as a result of this deenergization of the relay coil X1, thereby also deenergizing the relay coil X3. The relay switch X33 is turned off due to this deenergization, thereby also deenergizing the fan motor 16. This stops the operation of the fan motor 16 after a delay by a predetermined time after the refrigerant compressor 11 and the auger motor 25 are stopped (after the detection of the hunting).

The relay switch X12 is deenergized due to the above-mentioned deenergization of the relay coil X1. Since the relay switch X52 is turned on by the deenergization of the relay coil X5, however, the thawing heater 28 is controlled to be energized upon the on-state of the thermostat 29, while it is controlled to be deenergized upon the off-state thereof. Accordingly, the press head assembly 26 is kept to be heated under the control of the thermostat 29.

Moreover, the relay switches X72 and X32 are changed from the off-state to the on-state due to the deenergizations of the relay coil X7 and the relay coil X3, whereby the drain valve 34 is energized. As a result, the drain valve 34 is opened, to thereby discharge water in the refrigerating cylinder 23 and the water supply tank 33.

When the hunting is detected in the AC current flowing through the auger motor 25, the ice making operation of the auger-type ice making machine is stopped to protect the machine by the above-mentioned control. Further, when the hunting of the peak value PK of the AC current flowing through the auger motor 25 occurs four times during the time (for example, 20 seconds) corresponding to the predetermined time TM20, or when the state where the hunting of the peak value PK of the AC current flowing through the auger motor 25 occurs twice is repeated twice during the time (for example, 3 minutes) corresponding to the predetermined time TM30, the above-mentioned hunting detection process determines that abnormal current flows through the auger motor 25. The detection of the hunting is rapidly executed when the ice-scraping auger starts to freeze to thereby start to cause the hunting in the current flowing through the auger motor, thereby being capable of suppressing adverse effects to a minimum given on the auger motor 25, refrigerant compressor 11 or the like caused by the freezing in the refrigerating cylinder 23.

The peak value PK changes once from a small value to a great value even when great rush current flows through the auger motor 25 upon starting to activate the motor 25, so that this rush current is not determined to be abnormal. Accordingly, the operation of the auger motor 25, i.e., the operation of the auger-type ice making machine can be assured even after the above-mentioned detection of the abnormality.

Figure 5D:
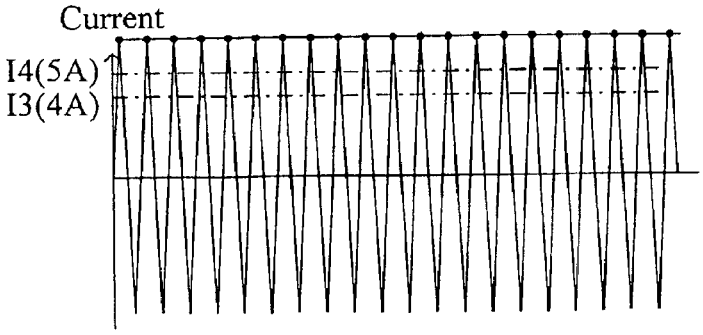
FIG. 5D is a waveform chart of AC current flowing through the auger motor when an ice-scraping auger is completely locked.

In the auger-type ice making machine of the present invention, the abnormality is not detected by the hunting detection process in case where excessive AC current continuously flows as shown in FIG. 5D due to a complete lock of the ice-scraping auger 23. However, the overcurrent breaker 44 is activated in this case to deenergize the auger motor 25 to thereby deenergize also the relay coil X5. This immediately controls to stop the operations of the auger motor 25 and refrigerant compressor 11 and to stop the operation of the fan motor 16 after a lapse of a predetermined time, to thereby protect the auger-type ice making machine, like the case of the hunting detection process.

When the auger-type ice making machine is controlled to be stopped as described above, the main switch 42 is turned off for checking the abnormality of the ice making machine, and then, the main switch 42 is again turned on. As a result, the operation of the auger-type ice making machine of the present invention is restarted according to the above-mentioned operations.

In the above-mentioned embodiment, the abnormality in the AC current flowing through the auger motor 25 is detected, when the occurrence of the hunting four times or more is detected during a predetermined time (for example, 20 seconds), or when the occurrence of the hunting twice or more times during a predetermined time (for example, 20 seconds) is detected twice or more times during a predetermined time (for example, 3 minutes) longer than the above-mentioned predetermined time. However, the detection of the abnormality in the AC current flowing through the auger motor 25 may be made by either one of the above-mentioned two cases.

Further, the time and number of times in the above-mentioned detecting conditions can suitably be set. It is to be noted that 2 or more integer times is required for the number of times. For example, the abnormality in the AC current flowing through the auger motor 25 may be detected when the hunting is detected to occur three or more times during a predetermined time (for example, 10 seconds) or when the hunting is detected to occur six or more times during a predetermined time (for example, 30 seconds). Alternatively, the abnormality in the AC current flowing through the auger motor 25 may be detected when the hunting that occurs twice or more times during a predetermined time (for example, 5 seconds) is detected twice or more times during a predetermined time (for example, 1 minute) that is longer than the above-mentioned predetermined time, or when the hunting that occurs three or more times during a predetermined time (for example, 15 seconds) is detected four or more times during a predetermined time (for example, 4 minutes) that is longer than the above-mentioned predetermined time.

Moreover, the above-mentioned embodiment detects, as the number of hunting times, the number of times wherein the peak value PK of the AC current flowing through the auger motor 25 rises from a state lower than the predetermined current I3 (for example, 4 A) to a state higher than the predetermined current I4 (for example, 5 A). However, the number of times wherein the peak value PK falls from a state higher than the predetermined current (for example, 5 A) down to a state not more than the predetermined current (for example, 4 A) may be equivalently detected as the number of hunting times. Further, both of the number of times wherein the peak value PK rises from the state lower than the predetermined current (for example, 4 A) to the state not less than the predetermined current (for example, 5 A) and the peak value PK falls from the state higher than the predetermined current (for example, 5 A) down to the state not more than the predetermined current (for example, 4 A) may equivalently be detected as the number of hunting times.

Although an AC motor is used for the auger motor 25 in the above-mentioned embodiment, a DC motor can be used instead of the AC motor. In this case, the number of hunting times of the sample value itself of the current flowing through the DC motor every predetermined time may be detected instead of the peak value PK of the AC current.

In the above-mentioned embodiment, when the abnormality in the current flowing through the auger motor 25 is detected by the hunting detection, a total operation of the auger-type ice making machine including the operations of the auger motor 25 and refrigerant compressor 11 is stopped, and then, the main switch 42 is again turned on to restart the operation of the machine. However, the following operation may be adopted wherein only the operations of the auger motor 25 and the refrigerant compressor 11 are stopped in response to the detection of the abnormality, an elapsed time from the detection of the abnormality is counted by the timer, and after a lapse of a predetermined time (for example, 20 minutes) from the detection of the abnormality, the operations of the auger motor 25 and the refrigerant compressor 11 are automatically restarted, since the auger-type ice making machine may be re-operated so long as the freezing in the ice-scraping auger 23 is eliminated.

Further, a heater 91 may be disposed to the evaporator 15 or the refrigerating cylinder 23 as shown in FIG. 1. When the abnormality in the current flowing through the auger motor 25 is detected by the hunting detection, the heater 91 may be energized in synchronous with stopping the operations of the auger motor 25 and the refrigerant compressor 11 for rapidly melting ice in the auger 23. Similar to the above-mentioned case, the auger motor 25 and the refrigerant compressor 11 may automatically be re-operated together with the deenergization of the heater 91 in this case, thereby restarting the operation of the auger-type ice making machine.

Additionally, a by-pass line 92 is arranged that communicates from the exhaust port of the refrigerant of the refrigerant compressor 11 to the upstream side of the evaporator 15 as shown by broken lines in FIG. 1, and a hot gas valve 93 composed of an electromagnetic valve is disposed on the by-pass line 92. When the abnormality in the current flowing through the auger motor 25 is detected by the hunting detection, the hot gas valve 92 may be energized to open the valve 92 in synchronous with stopping the operation of the auger motor 25. It is to be noted that the refrigerant compressor 11 is not halted but kept to be operated in this case. Opening the hot gas valve 92 directly supplies high-temperature high-pressure refrigerant (hot gas) ejected from the refrigerant compressor 11 to the evaporator 15, thereby being capable of rapidly melting ice in the ice-scraping auger 23.

In this case, the auger motor 25 may automatically be re-operated after a lapse of a predetermined time (for example, 10 minutes) by time-count with the timer as well as the hot gas valve 93 may be deenergized, to thereby restart the operation of the auger-type ice making machine, as described above. Instead of the time-count with the timer, a temperature sensor for detecting the temperature of the refrigerant is provided at the low-pressure side of the refrigerating system, i.e., at the downstream side of the evaporator 15, whereby the hot gas valve 93 is deenergized to stop the supply of the hot gas to the evaporator 15 when the detected temperature of the refrigerant becomes higher than the predetermined temperature.

The operation including the operation of the auger motor 25 is not required to be stopped so long as ice in the ice-scraping auger 23 can be melted during an extremely short period of time because the heater 91 and the hot gas has high capability for melting ice. Specifically, when the abnormality in the current flowing through the auger motor 25 is detected by the hunting detection, the heater 91 or the hot gas valve 92 may be started to be energized, and then, deenergized after a predetermined time (for example, 10 minutes) for continuing the energization to the auger motor 25 and the refrigerant compressor 11.

Further, in carrying out the present invention, it is not limited to the foregoing embodiments or variations thereof, but various modifications can be made as long as they do not depart from the object of the present invention.

What is claimed is:

1. An abnormality detecting device of an auger-type ice making machine provided with a refrigerating cylinder having an evaporating pipe of a refrigerating system at its outer periphery, to the inside of which water for making ice is supplied, an ice-scraping auger for scraping ice formed on the internal surface of the refrigerating cylinder and an auger motor for driving the ice-scraping auger, the abnormally detecting device comprising:

abnormality determining means for determining an abnormality in the auger-type ice making machine when a hunting occurs a predetermined number of times or more, in the current flowing through the auger motor during a predetermined time said predetermined number of times being not less than 2.

2. An abnormality detecting device of an auger-type ice making machine provided with a refrigerating cylinder having an evaporating pipe of a refrigerating system at its outer periphery, to the inside of which water for making ice is supplied, an ice-scraping auger for scraping ice formed on the internal surface of the refrigerating cylinder and an auger motor for driving the ice-scraping auger, the abnormality detecting device comprising:

hunting detection means for detecting an occurrence of a hunting, when a hunting occurs a predetermined number of times or more that is not less than 2 within the current flowing through the auger motor, and is during a first predetermined time; and abnormality determining means for determining that an abnormality has occurred in the auger-type ice making machine when the hunting detection means detects that the hunting occurs a predetermined number of times or more that is not less than 2 in the current flowing through the auger motor during a second predetermined time that is longer than the first predetermined time.

3. An abnormality detecting device of an auger-type ice making machine provided with a refrigerating cylinder having an evaporating pipe of a refrigerating system at its outer periphery, to the inside of which water for making ice is supplied, an ice-scraping auger for scraping ice formed on the internal surface of the refrigerating cylinder and an auger motor for driving the ice-scraping auger, the abnormality detecting device comprising:

crossing detection means for detecting that the current flowing through the auger motor crosses a reference value in either a direction from bottom to top or a direction from top to bottom; and abnormality determining means for determining that an abnormality occurs in the auger-type ice making machine when the crossing detection means detects the crossing a predetermined number of times or mores that is not less than 2, during a predetermined time.

4. An abnormality detecting device of an auger-type ice making machine provided with a refrigerating cylinder having an evaporating pipe of a refrigerating system at its outer periphery, to the inside of which water for making ice is supplied, an ice-scraping auger for scraping ice formed on the internal surface of the refrigerating cylinder and an auger motor for driving the ice-scraping auger, the abnormality detecting means device comprising:

crossing detection means for detecting that the current flowing through the auger motor crosses over a reference value in either a direction from bottom to top or a direction from top to bottom;

hunting detection means for detecting an occurrence of a hunting, when the crossing detection means detects the crossing a predetermined number of times or more, that is not less than 2, and is during a first predetermined time; and abnormality determining means for determining that an abnormality occurs in the auger-type ice making machine when the hunting detection means detects that the hunting occurs a predetermined number of times or more that is not less than 2 in the current flowing through the auger motor during a second predetermined time that is longer than the first predetermined time.

5. An abnormality detecting device according to claim 1, wherein the auger motor is an AC current flowing through the auger motor is an amplitude of AC current flowing through the AC motor.

6. An abnormality detecting device according to claim 2, wherein the auger motor is an AC motor and the current flowing through the auger motor is an amplitude of AC current flowing through the AC motor.

7. An abnormality detecting device according to claim 3, wherein the auger motor is an AC motor, and the current flowing through the auger motor is an amplitude of AC current flowing through the AC motor.

8. An abnormality detecting device according to claim 4, wherein the auger motor is an AC motor, and the current flowing through the auger motor is an amplitude of AC current flowing through the AC motor.

9. An abnormality detecting method of an auger-type ice making machine provided with a refrigerating cylinder having an evaporating pipe of a refrigerating system at its outer periphery, to the inside of which water for making ice is supplied, an ice-scraping auger for scraping ice formed on the internal surface of the refrigerating cylinder and an auger motor for driving the ice-scraping auger, the abnormality detecting method comprising:

an abnormality determining step for determining that an abnormality occurs in the auger-type ice making machine when a hunting occurs a predetermined number of times or more, that is not less than 2, in the current flowing through the auger motor during a predetermined time.

10. An abnormality detecting method of an auger-type ice making machine provided with a refrigerating cylinder having an evaporating pipe of a refrigerating system at its outer periphery, to the inside of which water for making ice is supplied, an ice-scraping auger for scraping ice formed on the internal surface of the refrigerating cylinder and an auger motor for driving the ice-scraping auger, the abnormality detecting method comprising:

a hunting detection step for detecting as an occurrence of a hunting that a hunting occurs a predetermined number of times or more, that is not less than 2, in the current flowing through the auger motor during a first predetermined time; and an abnormality determining step for determining that an abnormality occurs in the auger-type ice making machine when the hunting detection step detects that the hunting occurs a predetermined number of times or more that is not less than 2 in the current flowing through the auger motor during a second predetermined time that is longer than the first predetermined time.

11. An abnormality detecting method of an auger-type ice making machine provided with a refrigerating cylinder having an evaporating pipe of a refrigerating system at its outer periphery, to the inside of which water for making ice is supplied, an ice-scraping auger for scraping ice formed on the internal surface of the refrigerating cylinder and an auger motor for driving the ice-scraping auger, the abnormality detecting method comprising:

a crossing detection step for detecting that the current flowing through the auger motor crosses over a reference value in either one of directions from bottom to top and from top to bottom; and an abnormality determining step for determining that an abnormality occurs in the auger-type ice making machine when the crossing detection step detects the crossing a predetermined number of times or more, that is not less than 2, during a predetermined time.

12. An abnormality detecting method of an auger-type ice making machine provided with a refrigerating cylinder having an evaporating pipe of a refrigerating system at its outer periphery, to the inside of which water for making ice is supplied, an ice-scraping auger for scraping ice formed on the internal surface of the refrigerating cylinder and an auger motor for driving the ice-scraping auger, the abnormality detecting method containing:

a crossing detection step for detecting that the current flowing through the auger motor crosses over a reference value in either one of directions from bottom to top and from top to bottom;

a hunting detection step for detecting as an occurrence of a hunting that the crossing detection step detests the crossing a predetermined number of times or more that is not less than 2 during a first predetermined time; and an abnormality determining step for determining that an abnormality occurs in the auger-type ice making machine when the hunting detection step detects that the hunting occurs a predetermined number of times or more that is not less than 2 in the current flowing through the auger motor during a second predetermined time that is longer than the first predetermined time.

13. An abnormality detecting method according to claim 9, wherein the auger motor is an AC motor and the current flowing through the auger motor is an amplitude of AC current flowing through the AC motor.

14. An abnormality detecting method according to claim 10, wherein the auger motor is an AC motor and the current flowing through the auger motor is an amplitude of AC current flowing through the AC motor.

15. An abnormality detecting method according to claim 4, wherein the auger motor is an AC motor and the current flowing through the auger motor is an amplitude of AC current flowing through the AC motor.

16. An abnormality detecting method according to claim 12, wherein the auger motor is an AC motor and the current flowing through the auger motor is an amplitude of AC current flowing through the AC motor.

* * * * *